United States Patent [19]

Haage

[11] Patent Number: 5,001,833

[45] Date of Patent: Mar. 26, 1991

[54] LETTER OPENER

[76] Inventor: Dieter Haage, 48 Kilmarnock Road, Engadine NSW 2233, Australia

[21] Appl. No.: 376,636

[22] Filed: Jul. 6, 1989

[30] Foreign Application Priority Data

| | | | |
|---|---|---|---|
| Jul. 13, 1988 | [AU] | Australia | PI9274 |
| Dec. 2, 1988 | [AU] | Australia | 26488/88 |
| Mar. 17, 1989 | [AU] | Australia | 31427/89 |

[51] Int. Cl.[5] ..... B25F 3/00

[52] U.S. Cl. ..... 83/610; 83/374; 83/912; 30/278; 30/134; 30/DIG. 3

[58] Field of Search ..... 30/2, DIG. 3, 123, 124, 30/294, 278, 279; 83/374, 375, 382, 610, 611, 912

[56] References Cited

U.S. PATENT DOCUMENTS

| | | | |
|---|---|---|---|
| 1,666,533 | 4/1928 | Heck . | |
| 1,976,156 | 10/1934 | Beidler | 83/611 X |
| 2,596,467 | 5/1952 | Buckens . | |
| 2,635,694 | 4/1953 | Calhoun et al. | 83/912 X |
| 3,225,441 | 12/1965 | Myers | 30/DIG. 3 X |
| 3,476,043 | 11/1969 | Erdley . | |
| 4,360,970 | 11/1982 | Ostroski et al. | 30/DIG. 3 X |
| 4,741,105 | 5/1988 | Wong | 30/DIG. 3 X |

FOREIGN PATENT DOCUMENTS

| | | | |
|---|---|---|---|
| 18206 | of 1914 | United Kingdom . | |
| 621186 | 4/1949 | United Kingdom . | |
| 637035 | 5/1950 | United Kingdom | 83/610 |
| 733080 | 7/1955 | United Kingdom . | |

*Primary Examiner*—Paul A. Bell
*Assistant Examiner*—Willmon Fridie, Jr.
*Attorney, Agent, or Firm*—Davis, Bujold & Streck

[57] ABSTRACT

A device for opening envelopes which comprises a rotatable shaft having an elongate recess in line with the axis of the shaft. A first cutting blade is located on the top edge of the recess and a second cutting blade is secured to a base which supports the shaft. The first and second blades are positioned such that they co-act in a shearing action on rotation of the shaft. To open an envelope, the edge of the envelope is positioned within the recess and the shaft is rotated causing the blades to co-act resulting in a sliver being cut from the envelope.

9 Claims, 6 Drawing Sheets

LETTER OPENER

TECHNICAL FIELD

This invention relates to a device for cutting paper and has particular application to opening envelopes and the invention is hereinafter described in such context. However, it will be understood that the invention does have a broader application, for example, the cutting device could be used to trim paper or photographic prints or as a general paper cutter.

BACKGROUND OF THE INVENTION

In many office environments, a large amount of the correspondence is done through letters. As a result, in every working day businesses and firms receive a large amount of mail which is often opened using a conventional letter opener. As there are often such large amounts of envelopes to be opened, this can become a time consuming process.

Two fundamental problems exist in attempting to devise a more efficient device for opening letters. Firstly, it is imperative that the contents are in no way damaged as the envelope is opened and therefore it is preferable that the envelope is opened by making a cut at the edge of the envelope or very close to the edge. The second problem associated with opening envelopes is that paper is a particularly fibrous material which makes it very difficult to cut when the paper is not in tension.

The traditional or knife like letter opener is able to overcome these two fundamental problems because the cutting blade of the letter opener is inserted into the envelope. The envelope is then opened by pulling the blade along an edge of the envelope thereby putting the paper at the edge in tension thus making it easier to cut. The problem with this method is that it cannot be done in a single action as the blade has to be carefully inserted then pulled.

A more efficient action to open an envelope would be if a fine sliver could be effectively guillotined off the edge of the envelope However, problems still exist with using a guillotine in that it is almost impossible to cut a very fine sliver of the edge of the envelope without first carefully lining up the envelope underneath the guillotine. Also, the paper has a tendency to buckle between the cooperating blades of the guillotine unless the blades are extremely accurately positioned as the paper at the cutting edge is not in tension.

SUMMARY OF THE INVENTION

The aim of the present invention is to provide a device which uses a guillotine type action but ameliorates the problems of accurately locating an envelope in relation to the cutting blades to ensure that only a fine sliver is cut and also the problem of providing coacting blades which enable paper to be cut when the paper is not in tension.

Therefore the present invention provides a device for opening an envelope comprising a cylindrical shaft rotatably mounted at both ends to a base to enable the shaft to rotate between a first and a second position, activation means operable to rotate the shaft between the first and second positions, an elongated recess being located in the shaft substantially in line with the axis of the shaft and having a first cutting blade on an outer edge of the recess, a second cutting blade secured to the base and positioned to coact with the first cutting blade in a shearing action as the shaft rotates from the first to the second position, the recess having a predetermined depth enabling an edge of an envelope to be inserted between the first and second blades into the recess to a depth such that upon activation of the actuation means to rotate the shaft from the first to the second position, a thin sliver is cut from the envelope.

In a further aspect of the present invention, there is provided a device for opening an envelope comprising a cylindrical shaft rotatably mounted at both ends to a base to enable the shaft to rotate between a first and a second position, actuation means operable to rotate the shaft between the first and second positions, an elongate recess located in the shaft substantially in line with the axis of the shaft and having a first cutting blade on an outer edge of the recess, a second cutting blade secured to the base and positioned to co-act progressively with the first cutting blade from one end thereof in a shearing action, the recess having a pre-determined depth enabling an edge of an envelope to be inserted between the first and second blades into the recess to a depth such that upon activation of the actuation means to rotate the shaft from the first to the second position, a thin sliver is cut from the envelope.

Preferably, the cutting edges of the first and second blades are not parallel to one another thereby enabling the cutting blades to coact progressively in said shearing action.

Preferably, the actuation means comprise a lever secured to the shaft being operable by the application of a downward force and there being a spring mechanism to automatically rotate the shaft from the second position to the first position when the force on the lever is removed.

Alternatively, actuation means may comprise electrically energised means. The electrically energised means comprising an electromagnet located within the base and activated by at least one switch and having a metal bar radially secured to the shaft and located above the electromagnet. Depression of the bar causes a corresponding depression of the switch thus activating the electromagnet thereby causing the bar to be forced downwardly towards the electromagnet resulting in the shaft rotating from the first to the second position A return spring may be located beneath the bar to automatically return the bar to the first position.

Preferably, the base includes a support plate located adjacent and parallel to the axis of the shaft and the second cutting blades is secured to the top edge of the support plate adjacent the recess of the shaft.

Preferably, clamping means are secured to the shaft above the recess such that as the shaft rotates from the first to the second position, an envelope inserted in the recess is clamped between the clamping means and the base.

Preferably, the shaft is rotatably mounted to the base by way of needle bearings.

Preferably a catchment area is located below the shaft and is accessed from the back of the device to collect slivers which are cut from the envelopes.

In use a top or side edge of an envelope is simply inserted into the recess and as the recess is of a predetermined depth, the envelope is correctly located to result in only a thin sliver of the envelope edge being cut. As the shaft is rotated from the first position to the second position, the first and second blades coact to shear a thin sliver from the envelope thus opening the envelope.

DESCRIPTION OF THE DRAWINGS

The invention will be more fully understood from the following description of a device for opening envelopes. The description is provided with reference to the accompanying drawings wherein.

DESCRIPTION OF THE PREFERRED EMBODIMENT

Figure 1:
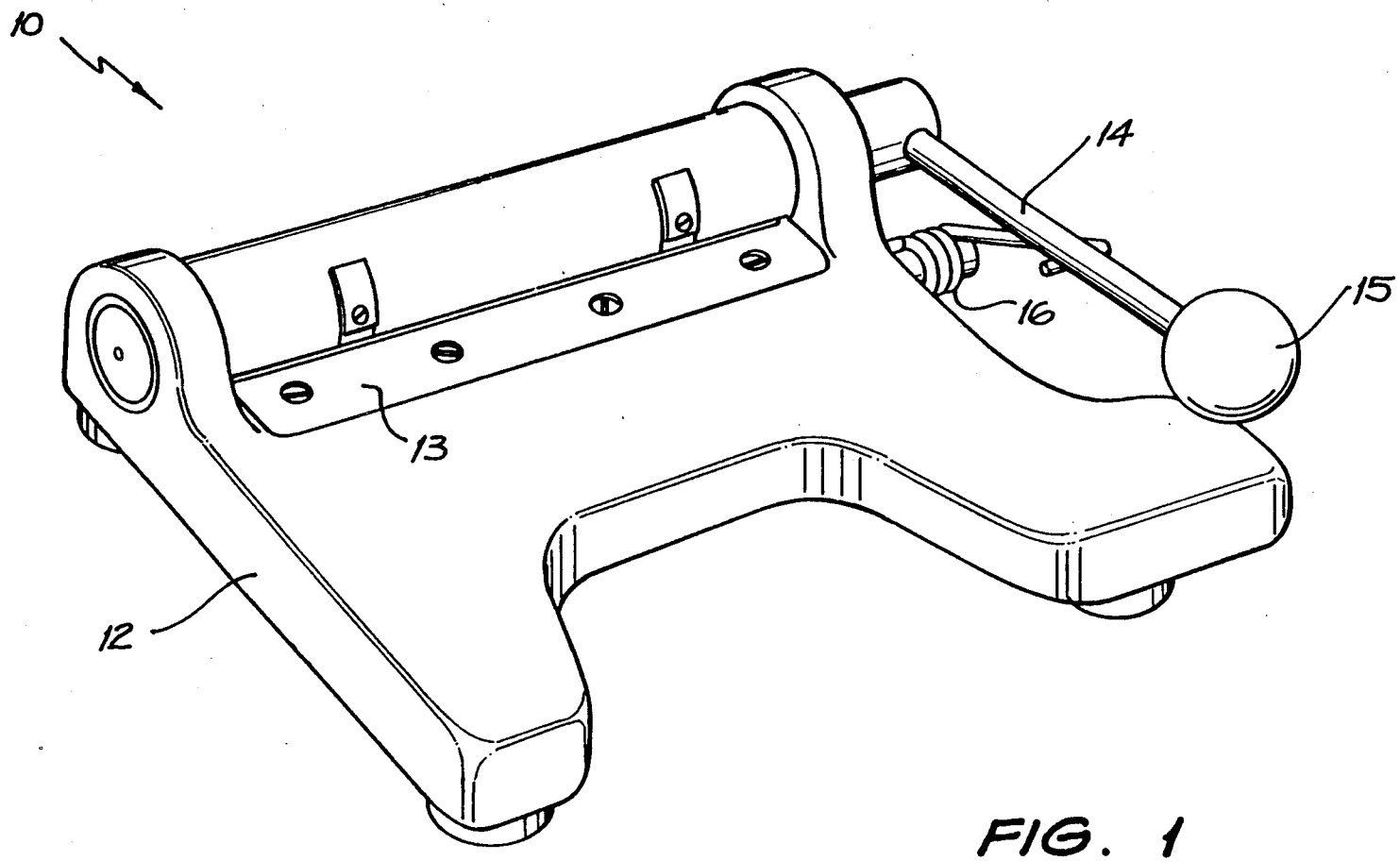
FIG. 1 is a perspective view of a first embodiment of the letter opener.

As illustrated in FIG. 1 the letter opener 10 of a first embodiment of the present invention comprises a shaft 11 rotatably secured at each of its ends to a base 12. In a typical arrangement the shaft 11 would be secured to the base by needle bearings (not shown).

A support plate 13 is secured to the base adjacent the shaft 11 such that the outer edge of the base plate 13 is parallel to the axis of the shaft 11.

A lever 14 is secured to one end of the shaft to provide means to enable the shaft to rotate between a first and a second position by the application of a downward force to the outer end 15 of the lever 14. A coil spring 16 is secured to the base and supports the lever 14 such that on the application of a downward force on the lever 14 to rotate the shaft 11 to the second position, the spring 16 compresses. On removal of the force on the lever the spring restores the lever to the first position.

Figure 2:
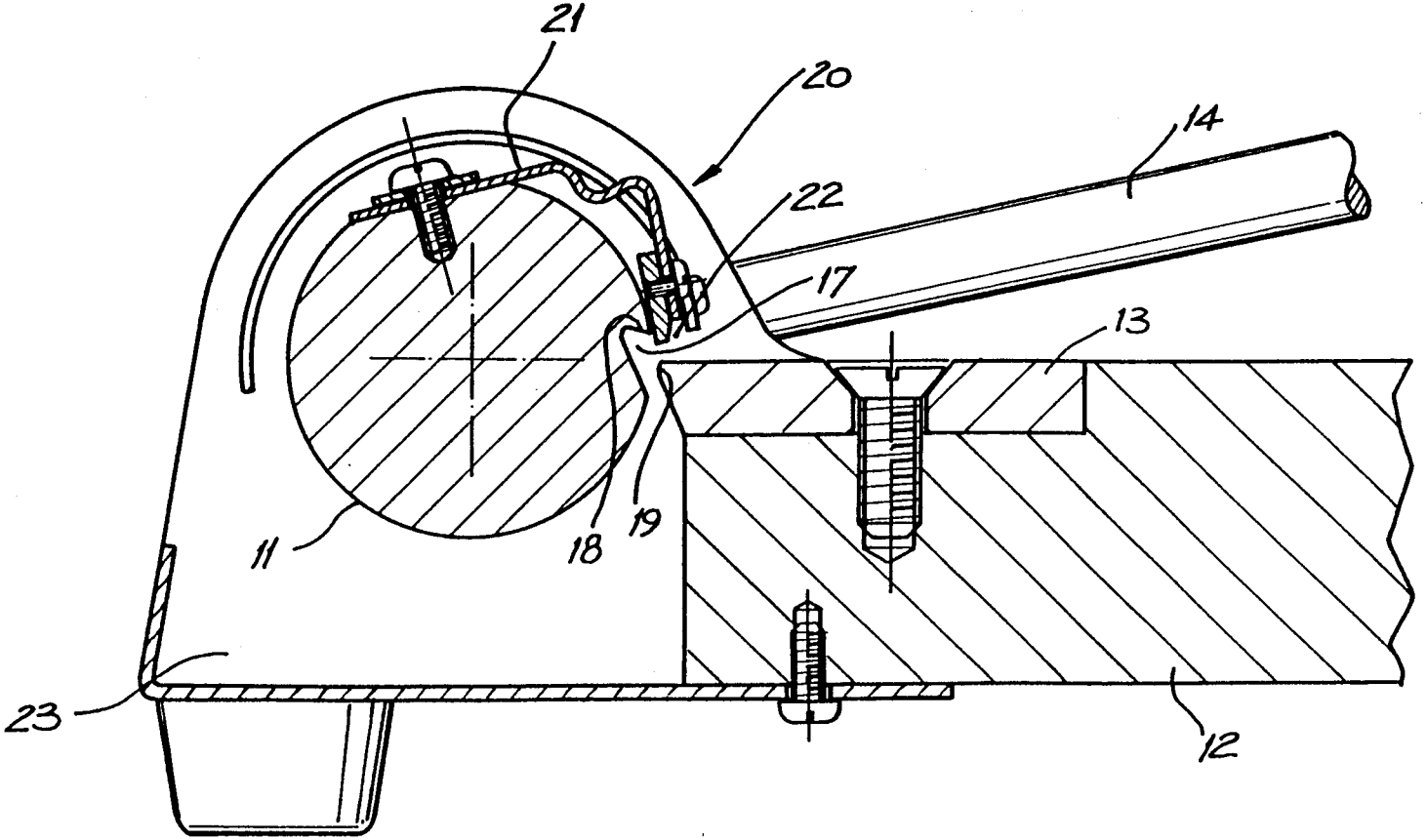
FIG. 2 is a partial transverse cross-section of the first embodiment of the letter opener.

As can be seen in FIG. 2 the shaft 11 contains a recess 17 having a first cutting blade 18 located on the upper edge of the recess 17. A second cutting blade 19 is located on the outer edge of the support plate 13 adjacent the shaft 11.

FIG. 2 shows the shaft in the first position and as can be seen the recess 17 is located on the shaft such that a small gap exists between the first cutting blade 18 and the second cutting blade 19 when the shaft is in the first position to enable an envelope (not shown) to be inserted between the two cutting blades (18 and 19) into the recess 17.

Clamping means 20 in the form of a steel band 21 is secured to the shaft 11 above the recess 17 and has its outer edge 22 extending adjacent the shaft below the first cutting blades 18. The steel band 21 is secured to the shaft 11 to allow the outer edge 22 of the steel band to move above the first cutting blade 18 when a force is applied to the outer edge 22 thus not impeding the movement of the shaft to the second position. In an alternative arrangement (not shown) a rubber strip is secured to the shaft 11 above the recess 17 and beyond the first cutting blade 18. The rubber strip is designed to have the ability to compress to a position where the outer edge of the rubber strip is above the recess.

A catchment area 23 is located below the shaft to catch the slivers cut from the envelopes when the letter opener is in operation. An opening is located at the back of the letter opener to give access to the catchment area for cleaning purposes.

FIGS. 3 to 7 show a second embodiment of the present invention. The difference between the two embodiments being the means by which the shaft is rotated from the first to the second position.

Figure 3:
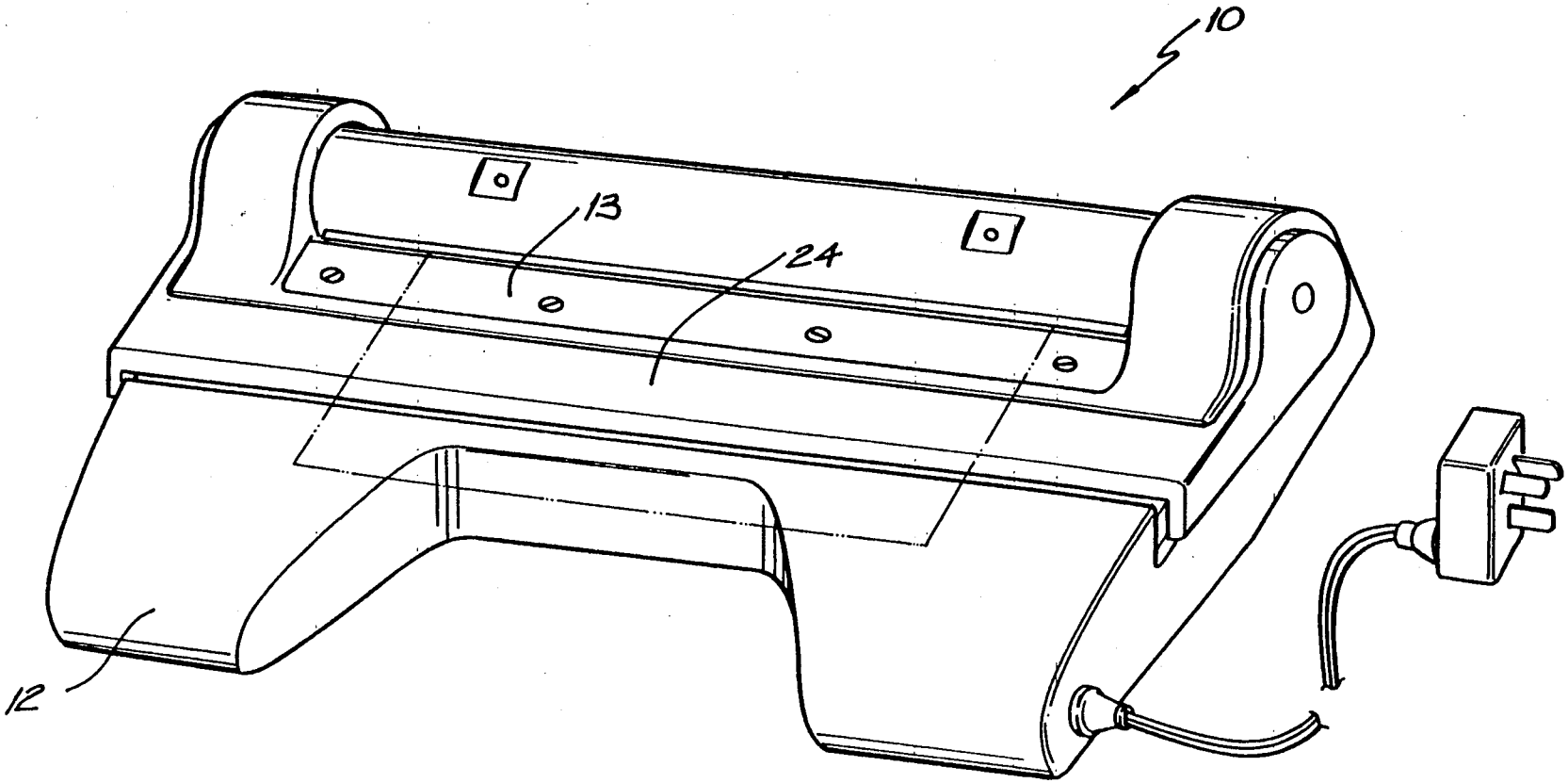
FIG. 3 is a perspective view of a second embodiment of the letter opener.

FIG. 3 shows a perspective view of the second embodiment. Instead of a lever arrangement to rotate the shaft as in the first embodiment,.electric means are provided to rotate the shaft in the second embodiment. In the second embodiment, a metal bar 24 is secured to both ends of the shaft 11 and extends across the front of the letter opener adjacent the support plate 13.

Figure 4:
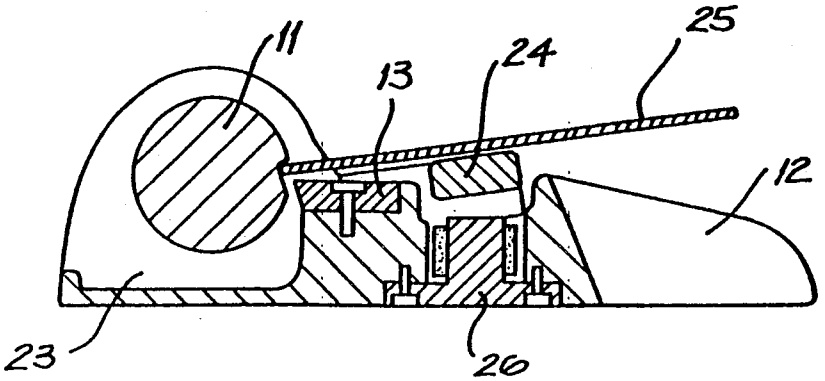
FIG. 4 is a transverse cross-section of the second embodiment of the letter opener when the shaft is in a first position.
Figure 5:
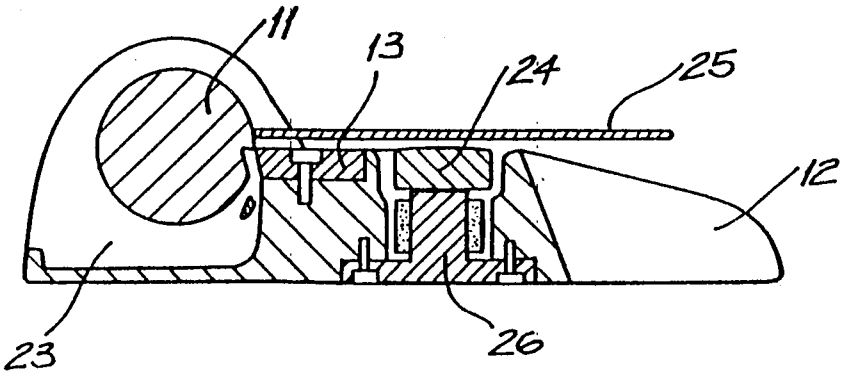
FIG. 5 is a transverse cross-section of the second embodiment of the letter opener when the shaft is in a second position.

FIG. 4 is a cross sectional view of the second embodiment of the present invention when the shaft is in the first position. As seen in FIG. 4 the bar 24 is raised from the base 12 such that when an envelope 25 is inserted into the recess 17 between cutting blades 18 and 19 the envelope 25 rests on the bar 24. By depressing the bar 24, the shaft 11 begins to rotate from the first to the second position.

However, a switch 27(FIG. 6) is located beneath the bar 24 and is activated by a slight depression of the bar 24 towards the base 12. Activation of the switch causes electromagnet 26 located directly below bar 24 to be charged. As the electromagnet is charged it attracts the metal bar 24 causing rapid movement of the bar towards the electromagnet 26 until it contacts the electromagnet 26. Movement of the bar 24 cause the shaft 11 to rotate and the position of the bar 24 when in contact with the electromagnet 26 is designed to cause the shaft to be located in the second position.

Figure 6:
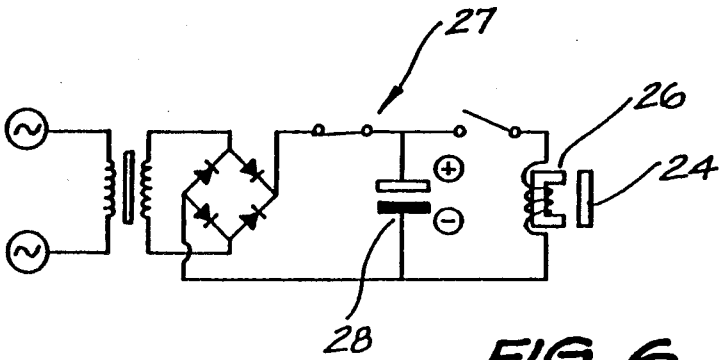
FIGS. 6 and 7 are schematic diagrams of the electric circuits of the second embodiment of the letter opener.
Figure 7:
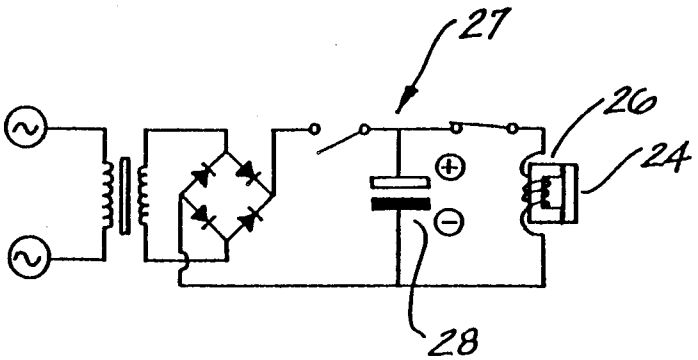

FIG. 6 shows a schematic diagram of the electrics of the second embodiment when the shaft is in a first position. As can be seen from FIG. 6 a two way switch 27 when in a first position causes capacitor 28 to be continually charged. On depression of the bar 24 the switch is activated and as seen in FIG. 7 causes the power supply to the capacitor to be cut and causes the electromagnet 26 to be charged by the capacitor 28. This induces the bar 24 to contact the electromagnet 26 causing the shaft to rotate to the second position. As the capacitor 28 discharges its charge, the electromagnet is released and the bar returns to the first position by way of return springs located beneath the bar. In this manner, the capacitor can deliver a high energy burst to the electromagnet enabling the rapid movement of the shaft.

Figure 8:
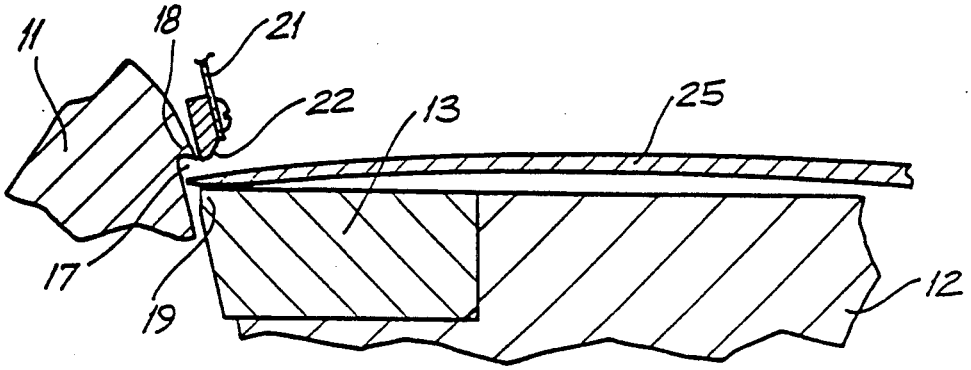
FIGS. 8, 9 and 10 are partial transverse cross-sections of the cutting mechanism of the letter opener, showing the cutting of an envelope inserted into the recess.
Figure 9:
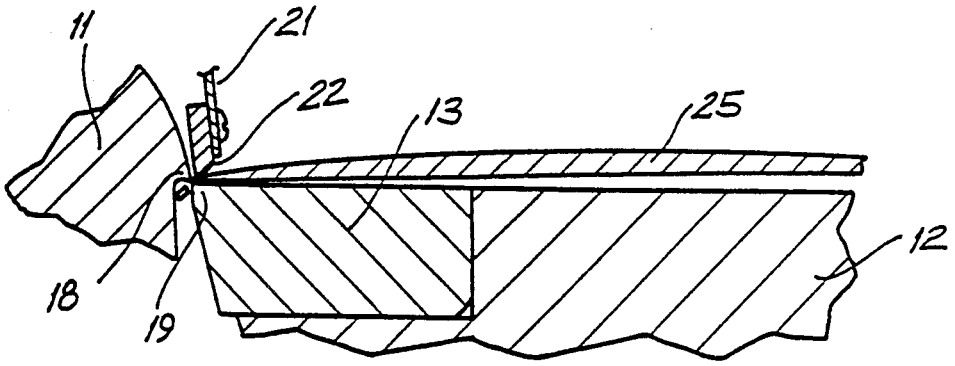
Figure 10:
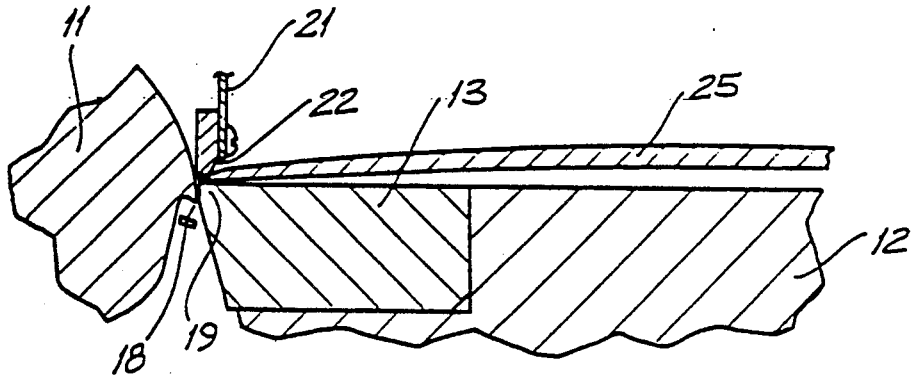

FIG. 8 to 10 illustrate the cutting action of the first and second blades as the shaft rotates from the first to the second position. The illustrations show the first embodiment of the present invention, however, it must be realised that the cutting action is exactly the same for either embodiment of the present invention.

As seen in FIG. 8 when the shaft is in a first position, an envelope 25 is easily located into the recess 17 between cutting blades 18 and 19. The recess 17 extends along the entire shaft between the ends where the shafts are rotatably secured to the base 12 and the recess extends sufficiently to enable an entire side of an envelope to be inserted into the recess. Once the envelope 25 is inserted, the shaft is rotated from the first to the second position and as shown in FIG. 9 the outer edge of the clamping means 20 contacts the envelope 25 enabling the envelope to be held firmly against the base plate 13. As the shaft 11 is rotated, the cutting blades 18 and 19 coact in a shearing action causing the edge of the envelope located in the recess 17 to be cut from the envelope. Furthermore, the base plate 13 has a curved surface below the blade 19 such that as the shaft rotates from the first to the second positions, the outer surface of the shaft above the cutting blade 18 remains adjacent the curved surface of the base plate 13, thereby ensuring that the paper cut from the envelope does not lodge between the blades 18 and 19. The edge of the envelope which has been cut then falls into the catchment area 23.

Figure 11:
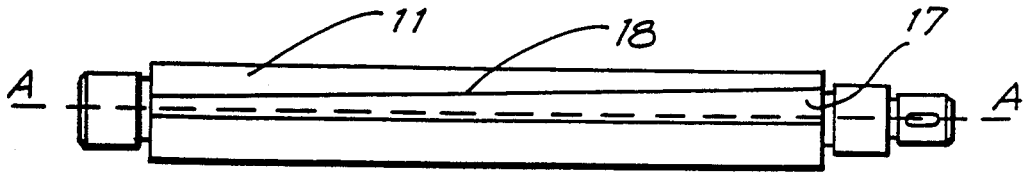
FIGS. 11, 12 and 13 are schematic front elevations of the shaft of the letter opener of the present invention.
Figure 12:
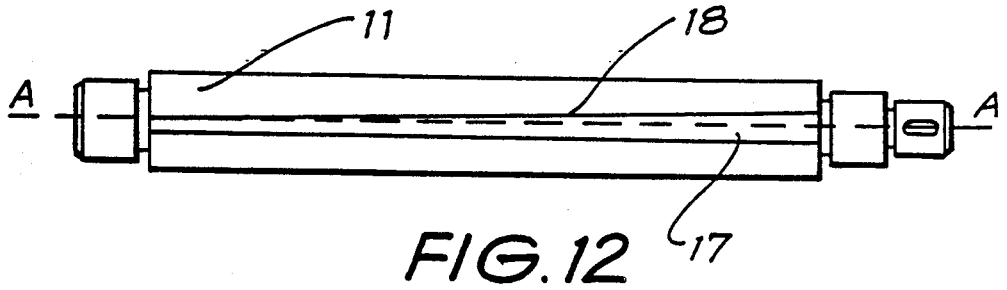
Figure 13:
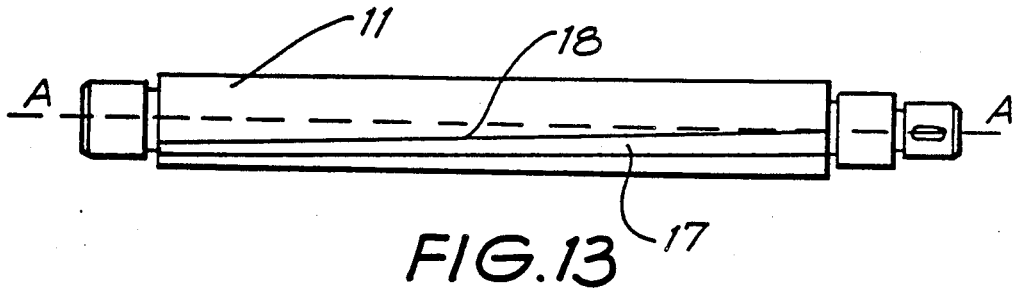

FIGS. 11 to 13 also illustrate the cutting action of the first and second blades as the shaft rotates from the first to the second position. These figures show the preferable arrangement wherein the blade co-act in a progressively shearing action. However, it must be realized that the device is operable in the arrangement wherein the blades are parallel to one another and therefore co-act in a straight shearing action.

The figures are schematic front elevations showing the shaft 11, the recess 17 and the first cutting blade 18. Line A—A represents the line of the second cutting blade 19.

As can be seen in FIGS. 11 to 13 the line of second cutting blades is substantially parallel to the axis of the shaft 11. However the first cutting blade is not parallel to the line A—A as it is disposed at an angle to the axis of the shaft. FIG. 11 shows schematically the position of the first cutting blade 18 to the second cutting blade (line A—A) when in the first position. As the shaft rotates between the first to the second position as shown in FIG. 13, the cutting blades 18 and 19 coact progressively from the lefthand end of the blades to the righthand end thereof in a shearing action due to the cutting blades 18 and 19 not being parallel Furthermore, as can be seen in FIG. 11 the recess 17 is still substantially parallel to the axis of the shaft 11 thereby enabling the edge of an envelope to be easily inserted into the recess 17 between the cutting blades 18 and 19.

With the blades 18 and 19 coacting to shear progressively across the recess 17, an envelope inserted into the recess can be cut more easily as the whole edge of the envelope is not cut at any instance but rather the sliver is cut progressively as the shaft rotates therefore resistance to the envelope being cut is much less. It has been found in practice that with the letter opener of the present invention slivers cut from the envelope can be as thin as 0.3 mm which ensures that there is no risk that the contents of the envelope are damaged.

Variations and modifications may be made in respect of the invention as above described and defined in the following claims.

What I claim is:

1. A device for opening an envelope comprising a cylindrical shaft rotatably mounted at both ends to a base to enable the shaft to rotate between a first and a second position, the base being located adjacent the shaft and extending between the ends of the shaft, actuation means operable on the shaft for rotating the shaft between the first and second positions, an elongate recess located in the shaft substantially in line with the axis of the shaft and having a first cutting blade on an outer edge of the recess, a second cutting blade rigidly secured to the base and positioned to coact with the first cutting blade in a shearing action as the shaft rotates from the first to the second position, the recess having a pre-determined depth enabling an edge of an envelope to be inserted between the first and second blades into the recess to a depth such that upon activation of the actuation means, to rotate the shaft from the first to the second position, a thin sliver is cut from the envelope, the device further comprising clamping means secured to the shaft above the recess, the clamping means having an outer end, supporting an engaging surface which is aligned substantially parallel to the base, which extends over the recess, wherein when the shaft rotates from the first to the second position, the clamping means rotates therewith and clamps a said envelope inserted into the recess between the engaging surface and the base prior to said thin sliver being cut from the envelope.

2. A device for opening an envelope comprising a cylindrical shaft rotatably mounted at both ends to a base to enable the shaft to rotate between a first and a second position, the base being located adjacent the shaft and extending between the ends of the shaft, actuation means operable on the shaft for rotating the shaft between the first and second positions, an elongate recess located in the shaft substantially in line with the axis of the shaft and having a first cutting blade on an outer edge of the recess, a second cutting blade rigidly secured to the base and positioned to co-act progressively with the first cutting blade from one end thereof in a shearing action, the recess having a pre-determined depth enabling an edge of an envelope to be inserted between the first and second blade into the recess to a depth such that upon activation of the actuation means, to rotate the shaft from the first to the second position, a thin sliver is cut from the envelope, the device further comprising clamping secured to the shaft above the recess, the clamping means having an outer end, supporting an envelope engaging surface that extends substantially parallel to said base, which extends over the recess, wherein when the shaft rotates from the first to the second position, the clamping means rotates therewith and clamps a said envelope inserted into the recess between the envelope engaging surface and the base prior to said thin sliver being cut from the envelope.

3. A device as claimed in claim 2 wherein the cutting edges of the first and second cutting blades are not parallel to one another thereby enabling the first and second cutting blades to coact progressively in said shearing action.

4. A device as claimed in claim 2 wherein the actuation means comprises a lever secured to the shaft, the actuation means being operable by the application of a downward force on the lever and there being a spring mechanism to automatically rotate the shaft from the second position to the first position when the force on the lever is removed.

5. A device as claimed in claim 2 wherein the actuation means comprise electrically energised means.

6. A device as claimed in claim 5 wherein the electrically energised means comprise an electromagnet located within the base, the electro magnet being activated by at least one switch, a metal bar being radially secured to the shaft and being located above the electromagnet and the switch such that a depression of the bar causes a corresponding depression of the switch activating the electromagnet and causing the bar to be forced downwardly towards the electromagnet and further causing a corresponding rotation of the shaft from the first to the second position, and a return spring arranged to automatically return the bar to the first position when the electromagnet is deactivated.

7. A device as claimed in claim 2 wherein the base includes a support plate located adjacent and parallel to the axis of the shaft and having the second cutting blade secured to the top edges of the support plate adjacent the recess located in the shaft.

8. A device as claimed in claim 2 wherein the shaft is rotatably mounted to the base by way of needle bearings.

9. A device as claimed in claim 2 wherein a catchment area is located below the shaft and is accessed from the back of the device.

* * * * *